US006283179B1

(12) United States Patent
Liao

(10) Patent No.: US 6,283,179 B1
(45) Date of Patent: Sep. 4, 2001

(54) WOOD PLANING MACHINE WITH A CARRIAGE LOCKING MECHANISM

(76) Inventor: Juen-Seng Liao, No. 295, Sec. 1, Nanking E. Rd., Tung Dist., Taichung City (TW)

( * ) Notice: Subject to any disclaimer, the term of this patent is extended or adjusted under 35 U.S.C. 154(b) by 0 days.

(21) Appl. No.: 09/576,580

(22) Filed: May 22, 2000

(51) Int. Cl.[7] ..... B27C 1/00

(52) U.S. Cl. ..... 144/130; 144/117.1; 403/109.1; 403/343

(58) Field of Search ..... 144/114.1, 117.1, 144/129, 130; 403/186, 190, 192, 109.1, 109.3, 300, 343

(56) References Cited

U.S. PATENT DOCUMENTS

| | | | | |
|---|---|---|---|---|
| 5,771,949 | | 6/1998 | Welsh et al. | 144/130 |
| 5,829,499 | * | 11/1998 | Liao | 144/130 |
| 6,085,812 | * | 7/2000 | Chiang | 144/130 |

* cited by examiner

*Primary Examiner*—W. Donald Bray
(74) *Attorney, Agent, or Firm*—Christie, Parker & Hale, LLP

(57) ABSTRACT

A planing machine includes a carriage locking mechanism disposed above a cutter carriage, which in turn, is connected movably to upstanding posts of a machine base that is disposed below the cutter carriage. The locking mechanism includes a pair of post bracing members, each of which extends at one side of a respective pair of the posts, and has two post embracing units that embrace the respective pair of the posts. The post bracing members are mounted on the carriage. A right regulator plate is disposed above the carriage, and has a first end portion connected pivotally to the right post bracing member, and a second end portion formed with a wheel accommodating slot. A left regulator plate has a first end portion fixed to the left post bracing member, and a second end portion overlapping the second end portion of the right regulator plate. The second end portion of the left regulator plate defines a shaft mounting hole in communication with the wheel accommodating slot, and having an axis offset from an axis of the slot. A shaft unit is disposed rotatably through the shaft mounting hole in the left regulator plate, and has an eccentric wheel fixed thereto. The eccentric wheel is confined rotatably within the slot.

4 Claims, 11 Drawing Sheets

WOOD PLANING MACHINE WITH A CARRIAGE LOCKING MECHANISM

BACKGROUND OF THE INVENTION

1. Field of the Invention

The invention relates to a wood planing machine, more particularly to a wood planing machine which is provided with a carriage locking mechanism for releasably locking a cutter carriage thereof.

2. Description of the Related Art

Referring to FIGS. 1 and 2, a conventional wood planing machine 10 according to U.S. Pat. No. 5,771,949 is shown to include a machine base 11, left and right pairs of upstanding posts 12, and a cutter carriage 13.

As illustrated, the machine base 11 has opposite mounting sides 111 spaced apart from each other in a transverse direction, and opposite feed-in and take-out sides spaced apart from each other in a longitudinal direction. The upstanding posts 12 (only one is shown in FIG. 2) extend upward from the machine base 11 at the mounting sides 111. The cutter carriage 13 is disposed above the machine base 11, and has opposite end portions 130 mounted movably on the upstanding posts 12 for sliding movement of the cutter carriage 13 along the upstanding,posts 12. A cutter device 140 (see FIG. 3) is mounted on the cutter carriage 13, and is rotatable about a horizontal axis that extends in the transverse direction.

A pair of screw rods 15 (see FIG. 2) are mounted rotatably on, and extend upwardly from the machine base 11 at the mounting sides 111 to pass threadedly through the cutter carriage 13 at the opposite end portions 130 thereof. The screw rods 15 have lower ends coupled with a transmission rod 14 (see FIG. 3) via a gear assembly which are also disposed in the machine base 11. A turning handle 16 is provided at the top end of one of the screw rods 15 such that rotation of the latter will cause the cutter carriage 13 to slide along the upstanding posts 12 so as to define a gap between the cutter carriage 13 and the machine base 11 for passage of a work piece 17 to be processed.

As best illustrated in FIGS. 3, 4 and 5, a carriage locking mechanism 20 includes a manually operable handle 21, two pairs of locking linkages 22 mounted respectively on two opposite ends of the handle 21, and four post clamps 23 anchored on the cutter carriage 40 and associated with the upstanding posts 12, respectively. Each of the locking linkages 22 includes first and second linkage members 221, 222 connected pivotally to each other at inner ends thereof and to the handle 21, and further connected pivotally to an adjacent pair of the post clamps 23 at outer ends thereof. Each of the second linkage members 222 is formed as two sliding pieces with a biasing spring 223 disposed therebetween. The handle 21 is movable against biasing action of the spring 223 from a releasing position (see FIG. 4) to a locking position (see FIG. 5), where an adjacent pair of the post clamps 23 are forced toward a respective one of the right and left pairs of the upstanding posts 12. At the locking position, the first and second linkage members 221, 222 are disposed in a straight line. Thus, the carriage 13 is locked relative the upstanding posts 12 so as to retain the same at a desired height relative to the machine base 11.

Some disadvantages that result from the use of the aforesaid conventional wood planing machine are as follows:

(i) It is noted that the carriage locking mechanism 20 employed in the conventional wood planing machine 10 includes a relatively large number of components, thereby resulting in a relatively long assembly time.

(ii) Fatigue of the springs 223 due to long tern use of the locking mechanism 20 will weaken the locking strength of the post clamps 23 relative to the upstanding posts 12.

SUMMARY OF THE INVENTION

Therefore, the object of this invention is to provide a wood planing machine which is clear of the aforementioned drawbacks that result from the use of the conventional wood planing machine.

Accordingly, the wood planing machine of the present invention includes a machine base, left and right pairs of upstanding posts, a cutter carriage, moving means, and a carriage locking mechanism. The machine base has opposite mounting sides spaced apart from each other in a transverse direction, and feed-in and take-out sides disposed apart from each other in a longitudinal direction. The upstanding posts extend upward from the machine base at the mounting sides. The cutter carriage is disposed above the machine base, and has opposite end portions mounted movably on the upstanding posts for sliding movement of the cutter carriage along the upstanding posts. The moving means moves the cutter carriage along the upstanding posts for adjusting the height of the cutter carriage relative to the machine base. The carriage locking mechanism locks the cutter carriage at a desired height relative to the machine base, and includes a pair of post bracing members disposed above the cutter carriage, each having an elongate plate portion that extends in the longitudinal direction at one side of a respective one of the left and right pairs of upstanding posts, and two substantially U-shaped post embracing units that are connected to opposite ends of the elongate plate portion for embracing a respective pair of the upstanding posts. Each of the post bracing members is mounted on the cutter carriage. A right regulator plate is disposed above the carriage, and has a first end portion connected pivotally to the elongate plate portion of the right post bracing member, and a second end portion with an annular wheel accommodating slot formed therein. A left regulator plate is disposed above the carriage, and has a first end portion fixed to the elongate plate portion of the left post bracing member, and a second end portion overlapping the second end portion of the right regulator plate. The second end portion of the right regulator plate defines an annular shaft mounting hole therethrough in communication with the wheel accommodating slot, and having an axis offset from an axis of the wheel accommodating slot. A coupling shaft unit is disposed rotatably through the shaft mounting hole in the left regulator plate, and has an eccentric wheel fixed eccentrically thereto. The eccentric wheel is confined rotatably within the wheel accommodating slot in the right regulator plate so as to interconnect the left and right regulator plates. The eccentric wheel has an outer periphery in sliding contact with an inner periphery defining the wheel accommodating slot such that rotation of the coupling shaft unit in clockwise and counterclockwise directions results in synchronous rotation of the eccentric wheel within the wheel accommodating slot, thereby consequently causing movement of the left and right post bracing members toward each other or away from each other so as to cause the embracing units to clamp the posts or to release the posts.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 6:
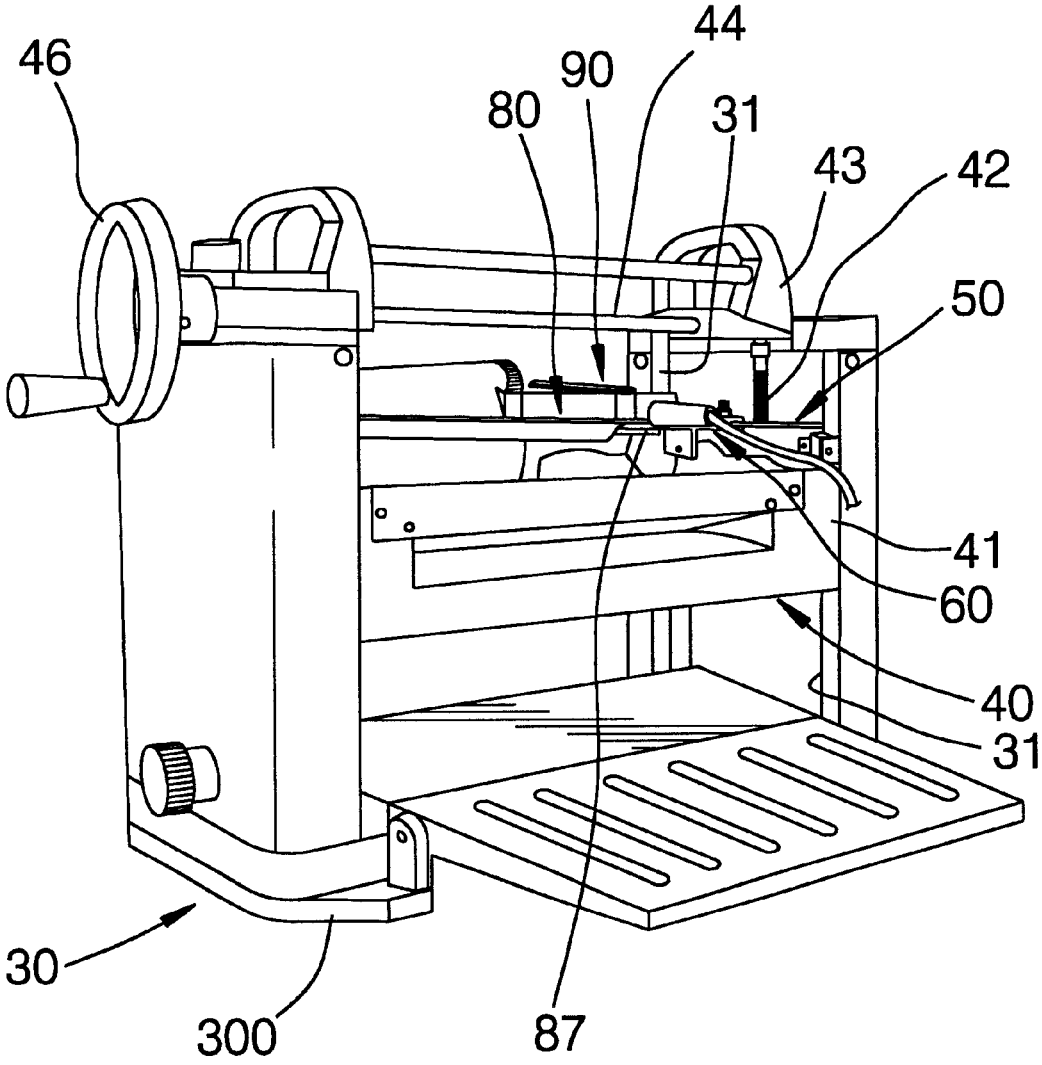
FIG. 6 is a perspective view of the preferred embodiment of a wood planing machine according to the present invention.
Figure 7:
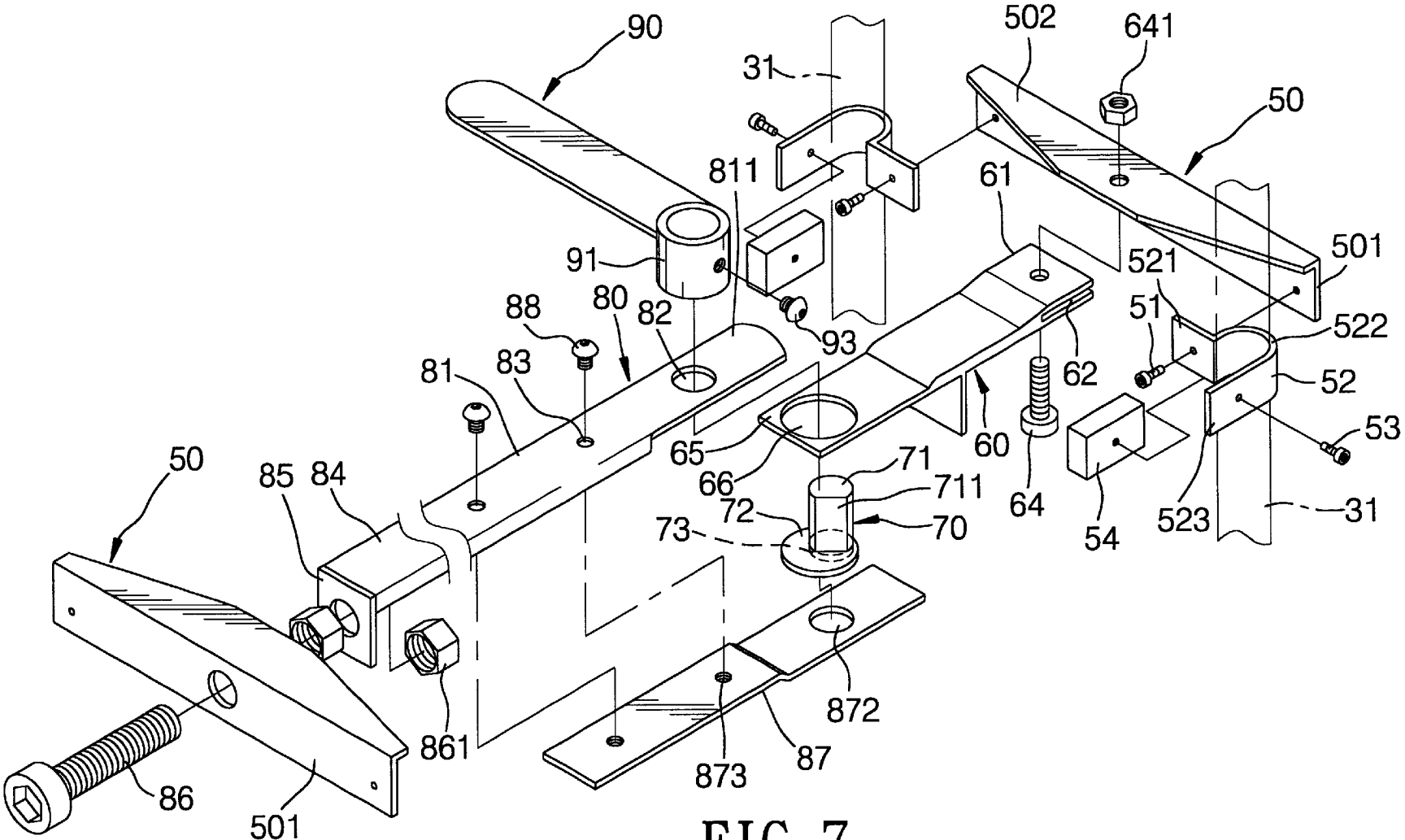
FIG. 7 is a fragmentary exploded view of the preferred embodiment, illustrating how a carriage locking mechanism is mounted on a cutter carriage thereof.

Referring to FIGS. 6 and 7, the preferred embodiment of a wood planing machine according to this invention is shown to include a machine base 30, left and right pairs of upstanding posts 31, a cutter carriage 40, moving means, and a carriage locking mechanism.

As illustrated, the machine base 30 has opposite mounting sides 300 spaced apart from each other in a transverse direction, and feed-in and take-out sides disposed apart from each other in a longitudinal direction.

The upstanding posts 31 are mounted on and extend upward from the machine base 30 at the mounting sides 300.

The cutter carriage 40 is disposed above the machine base 30, and has opposite end portions 41 mounted movably on the upstanding posts 31 for sliding movement of the cutter carriage 40 along the upstanding posts 31.

The moving means includes a pair of mounting brackets 43, a pair of screw rods 42 (only one is visible in FIG. 6), a rotary rod 44, and a worm drive mechanism (not shown). The mounting brackets 43 are mounted on distal top ends of the upstanding posts 31 so as to be spaced apart from each other in the transverse direction. The screw rods 42 are mounted rotatably on the mounting brackets 43 and pass threadedly through the cutter carriage 40. The rotary rod 44 is disposed in the transverse direction between the mounting brackets 43, and is journalled rotatably on the mounting brackets 43. The worm drive mechanism interconnects the rotary rod 44 and the screw rods 42. A control wheel 46 is mounted on one end of the rotary rod 44 such that rotation of the same will move the cutter carriage 40 along the upstanding posts 31 so as to adjust the height of the cutter carriage 40 relative to the machine base 30.

A cutter device (not shown) is mounted rotatably on the cutter carriage 40 in the conventional manner. Since the structure of the cutter device is not pertinent to the present invention, a detailed description thereof will be omitted herein for the sake of brevity.

The carriage locking mechanism locks the cutter carriage 40 at a desired height relative to the machine base 30, and includes left and right post bracing members 50, a right regulator plate 60, a left regulator plate 80, and a coupling shaft unit 70. Each of the post bracing members 50 is disposed above the cutter carriage 40, and has an elongate plate portion 501 that extends in the longitudinal direction at one side of a respective one of the left and right pairs of upstanding posts 31, and two substantially U-shaped post embracing units 52 that are connected to opposite ends of the elongate plate portion 501 for embracing the upstanding posts 31 of the left and right pairs. Four screws 51 mount the post embracing units 52 on the post bracing members 50. Each of the post bracing members 50 is mounted on the cutter carriage 40.

The right regulator plate 60 is disposed above the carriage 40 to extend in the transverse direction. The plate 60 has a first end portion 61 provided with a slit 62 within which an upper plate portion 502 of the right post bracing member 50 is connected pivotally by bolt and nut means 64,641, and a second end portion 65 with an annular wheel accommodating slot 66 formed therein.

The left regulator plate 80 is disposed above the carriage 40 to extend in the transverse direction. The plate 80 has a first end portion 84 formed with a nut mounting plate 85 that is fixed to the elongate plate portion 501 of the left post bracing member 50 by bolt and nut means 86,861, and a second end portion 811 overlapping the second end portion 65 of the right regulator plate 60. The second end portion 811 of the left regulator plate 80 defines an annular shaft mounting hole therethrough in communication with the wheel accommodating slot 66, and has an axis offset from an axis of the wheel accommodating slot 66 in the right regulator plate 60.

Figure 12A:
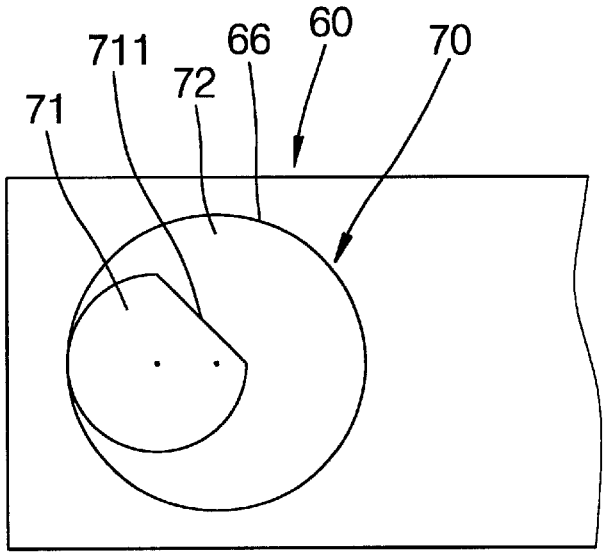
FIG. 12A is an enlarged top view of a portion of the preferred embodiment shown in FIG. 8.
Figure 12B:
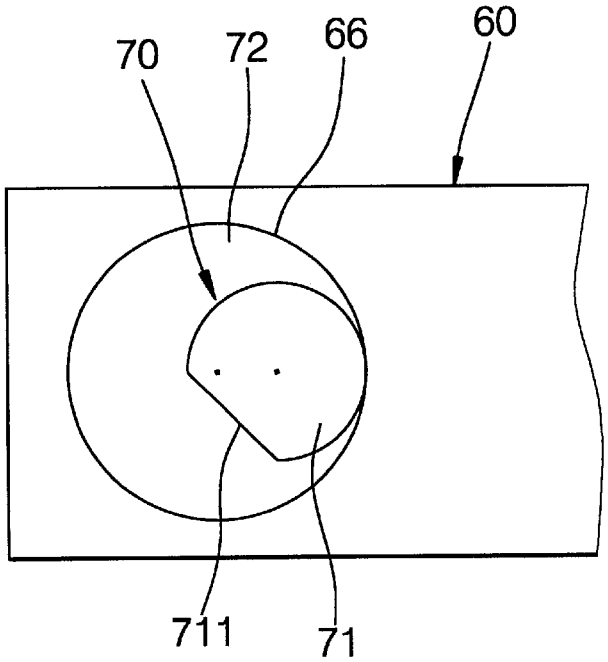
FIG. 12B is an enlarged top view of a portion of the preferred embodiment shown in FIG. 10.

The coupling shaft unit 70 extends rotatably through the shaft mounting hole in the left regulator plate 80, and has an eccentric wheel 72 fixed eccentrically thereto in such a manner that the eccentric wheel 72 is confined rotatably within the wheel accommodating slot 66 in the right regulator plate 60 so as to interconnect the left and right regulator plates 80,60 in the transverse direction. The eccentric wheel 72 has an outer periphery in sliding contact with an inner periphery that defines the wheel accommodating slot 66 (see FIGS. 12A and 12B) such that rotation of the coupling shaft unit 70 in clockwise and counterclockwise directions (see FIGS. 8 and 10) results in synchronous rotation of the eccentric wheel 72 within the wheel accommodating slot 66, thereby consequently causing movement of the left and right post bracing members 50 toward each other or away from each other so as to cause the embracing units 52 to clamp the posts 31 (see FIG. 10) or to release the posts 31 (see FIG. 8).

Preferably, an operating lever 90 is fixed to the coupling shaft unit 70 to facilitate turning of the same in the clockwise and counterclockwise directions.

In this embodiment, the left regulator plate 80 includes a first left plate 81 connected to the elongate plate portion 501 of the left post bracing member 50, and a second left plate 87 connected to the first left plate 81 by screws 88 that extend threadedly through holes 83, 873 adjacent to the first end portion 84 of the left regulator plate 80. The first and second left plates 81,87 are disposed one over the other, and sandwich the second end portion 65 of the right regulator plate 60 therebetween. The shaft mounting hole is defined by a first hole part 82 in the first left plate 81 and a second hole part 872 in the second left plate 87. The first and second hole parts 82,872 are aligned with the wheel accommodating slot 66 in the right regulator plate 60.

The coupling shaft unit 70 further includes a first shaft part 71 projecting from one side of the eccentric wheel 72 into the first hole part 82 in the first left plate 81, and a second shaft part 73 projecting from the other side of the eccentric wheel 72 into the second hole part 872 in the second left plate 87. The first and second shaft parts 71, 73 are coaxial with one anther and are off-center relative to the eccentric wheel 72. Preferably, the first shaft part 71 is formed with a flat surface 711 such that a tubular sleeve 91 of the operating lever 90 can be sleeved therearound and fastened securely thereto by a fastener screw 93.

Figure 1:
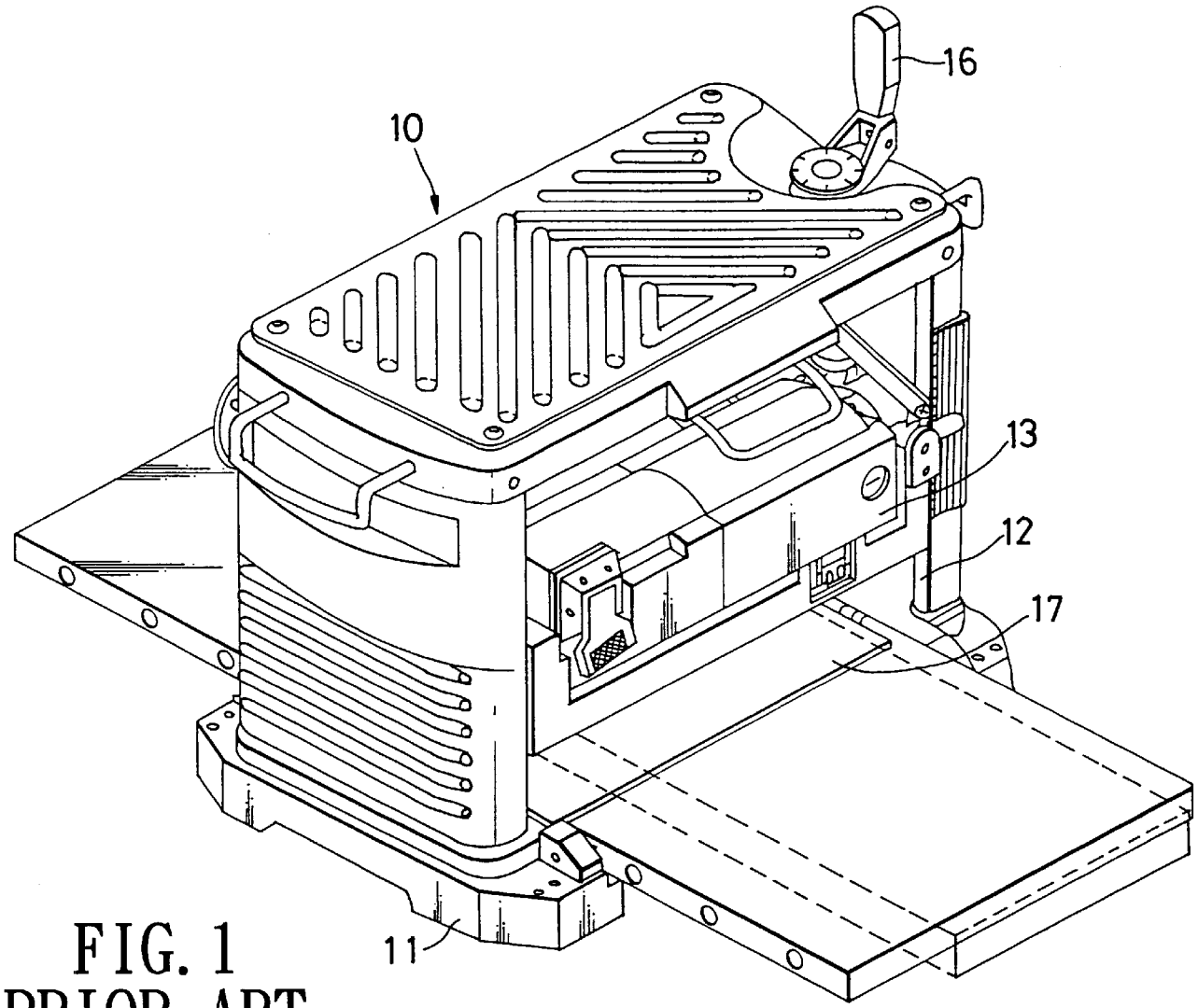
FIG. 1 PRIOR ART
FIG. 1 is a perspective view of a conventional wood planing machine disclosed in U.S. Pat. No. 5,771,949.
Figure 2:
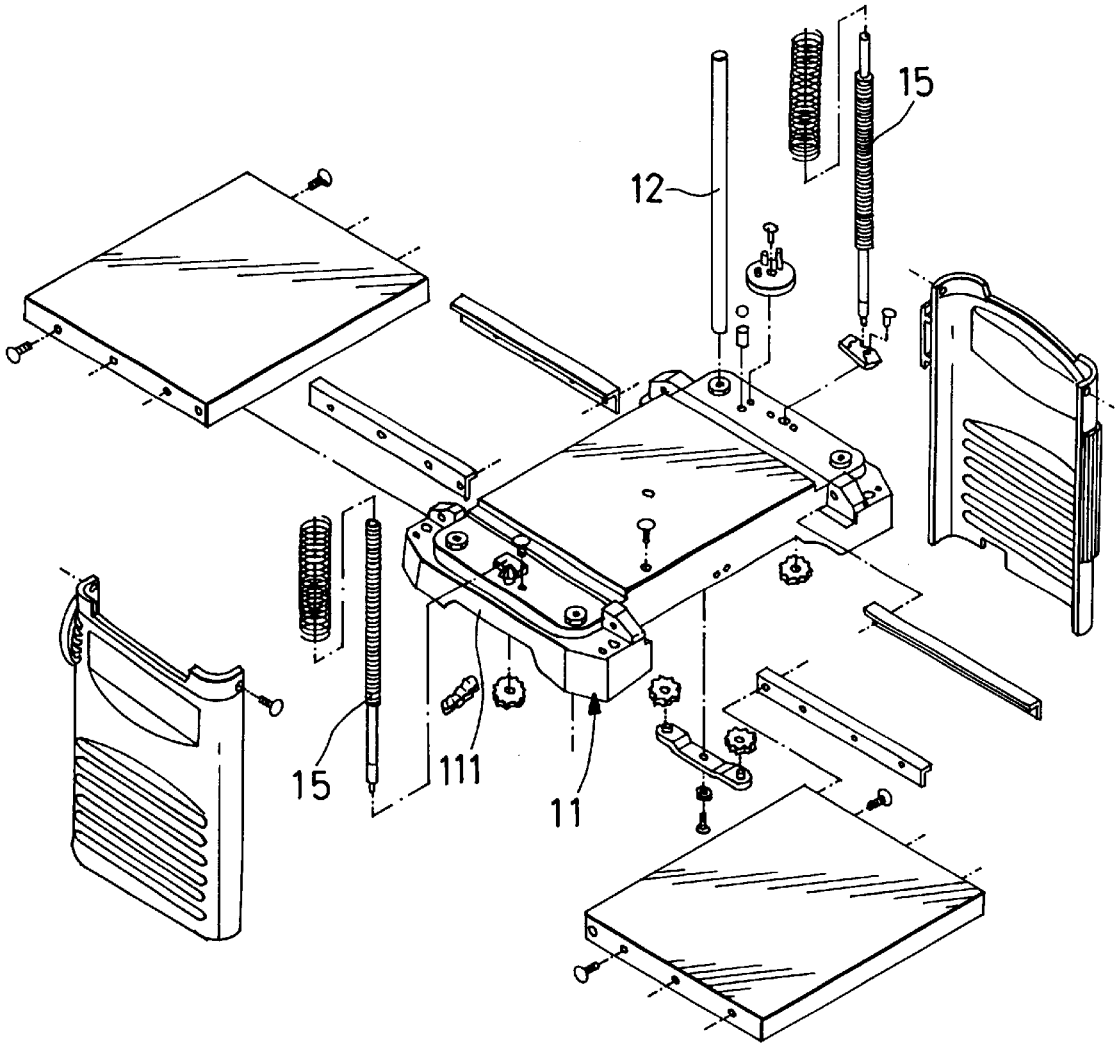
FIG. 2 PRIOR ART
FIG. 2 is a fragmentary exploded view of the conventional wood planing machine of FIG. 1.
Figure 3:
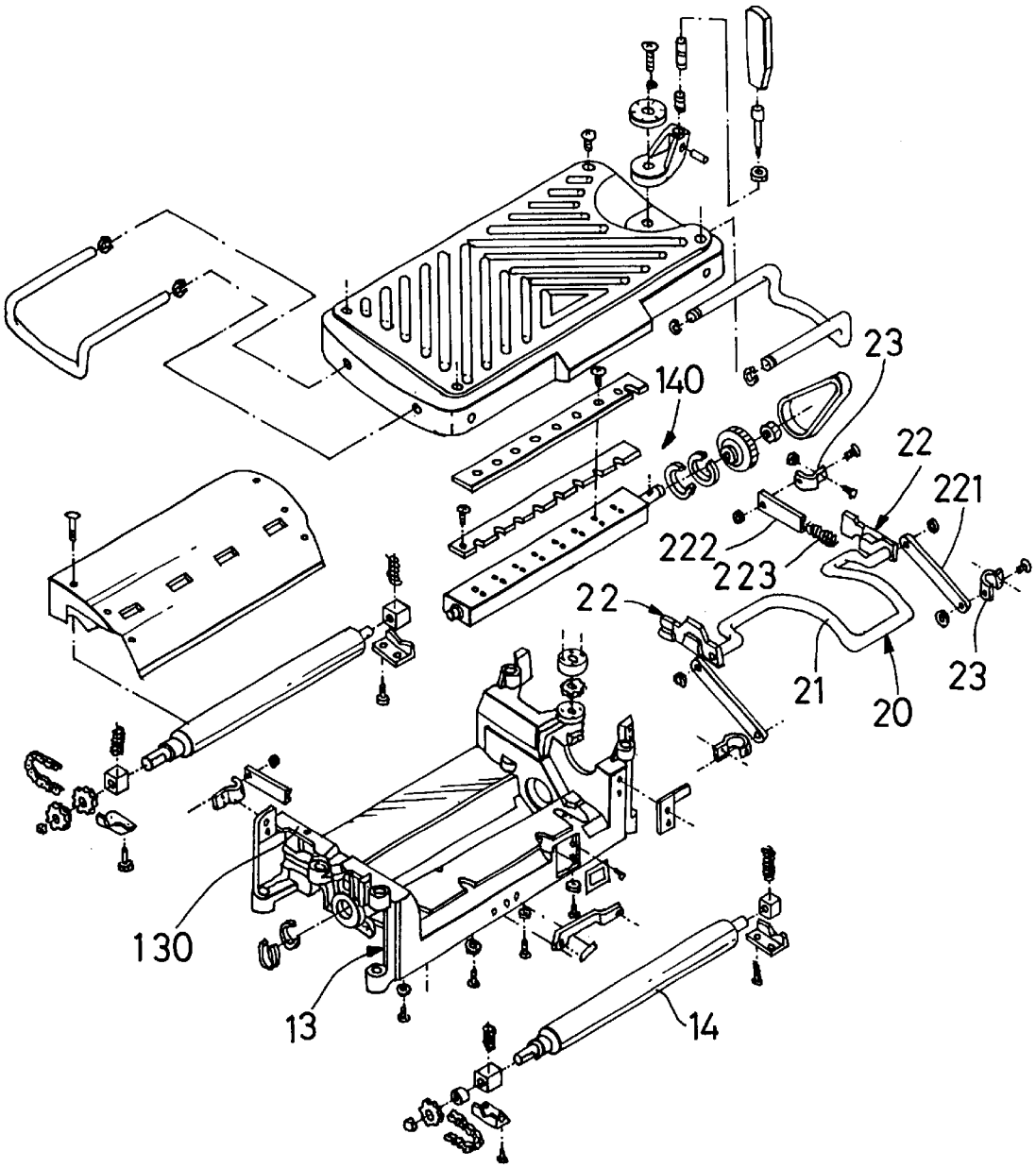
FIG. 3 PRIOR ART
FIG. 3 is another fragmentary exploded view of the conventional wood planing machine of FIG. 1, illustrating how a carriage locking mechanism is mounted therein.
Figure 4:
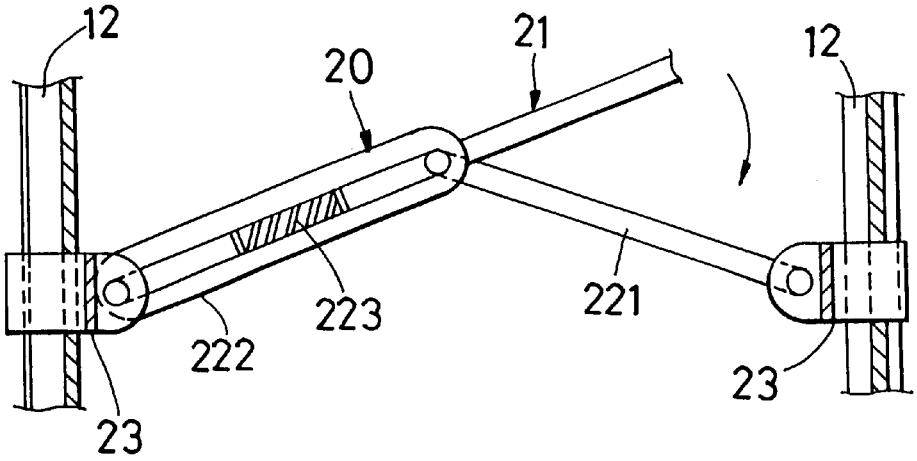
FIG. 4 PRIOR ART
FIG. 4 is a fragmentary schematic view of the wood planing machine of FIG. 1, illustrating the carriage locking mechanism in a releasing position.
Figure 5:
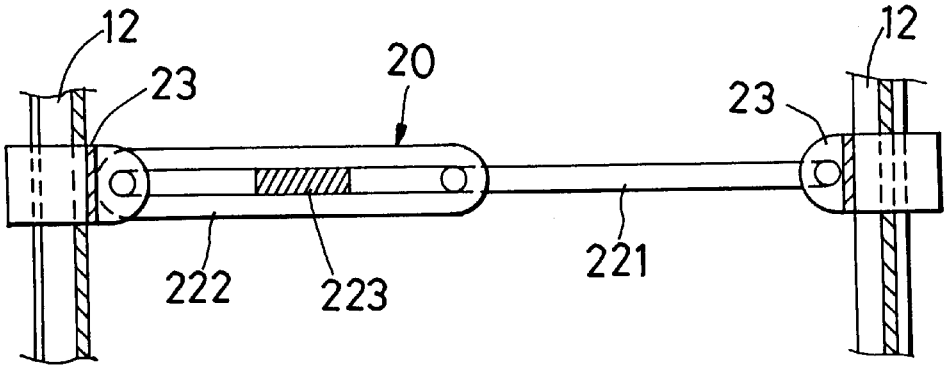
FIG. 5 PRIOR ART
FIG. 5 is a fragmentary schematic view of the wood planing machine of FIG. 1, illustrating the carriage locking mechanism in a locking position.
Figure 8:
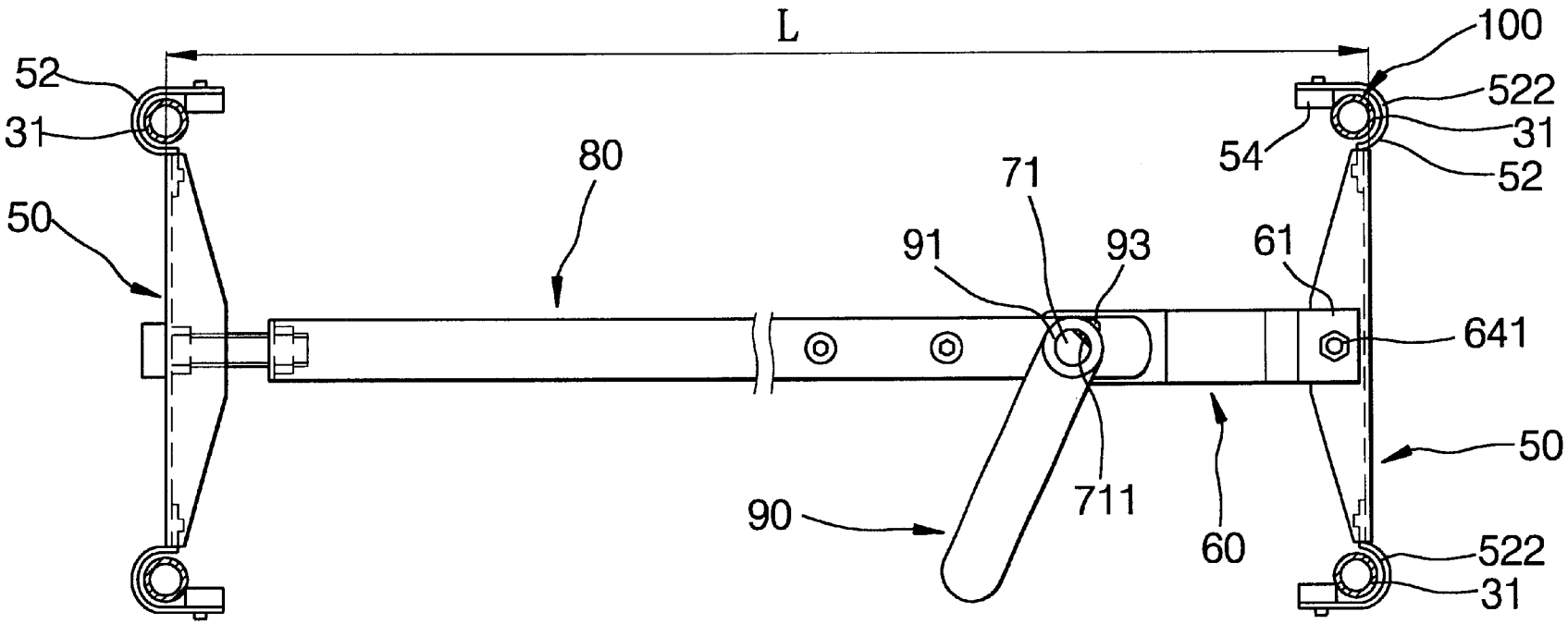
FIG. 8 is a schematic partly sectional top view of the preferred embodiment, illustrating how the cutter carriage is unlocked relative to left and right pairs of the upstanding posts.
Figure 9:
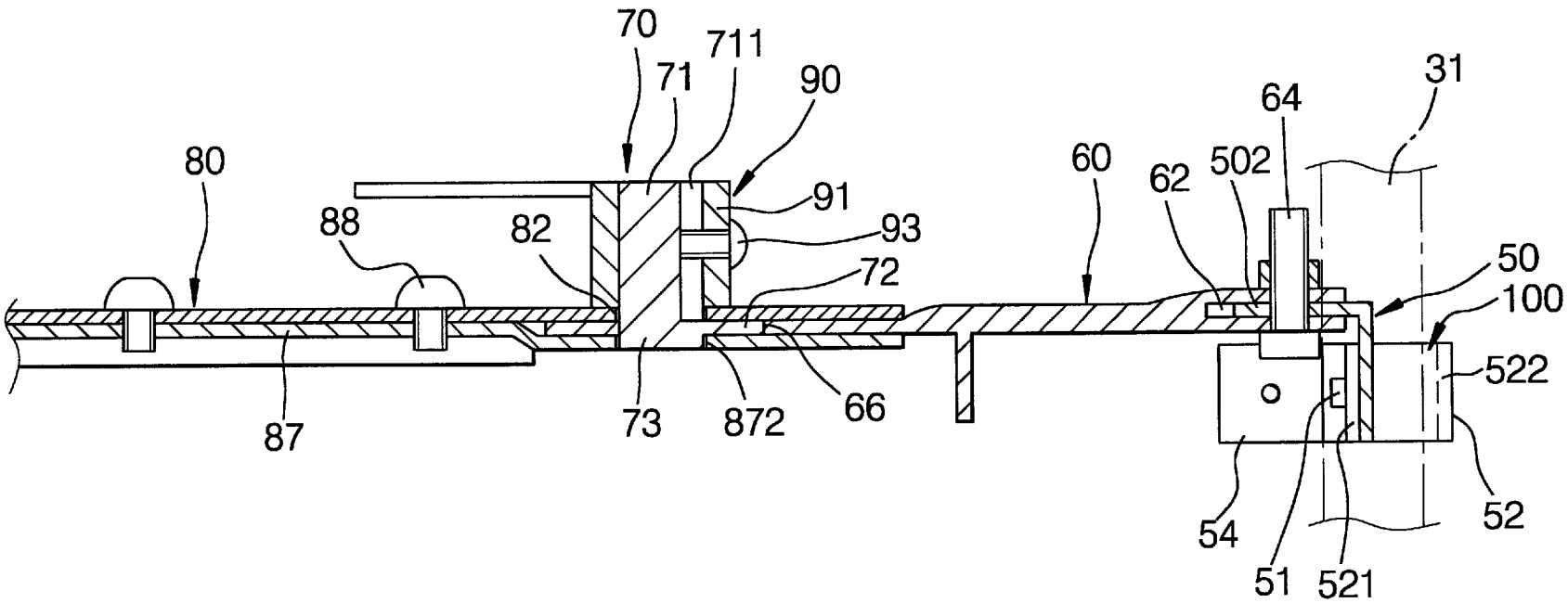
FIG. 9 is a schematic sectional side view of the preferred embodiment shown in FIG. 8, illustrating how the cutter carriage is unlocked relative to the left and right pair of the upstanding posts.
Figure 10:
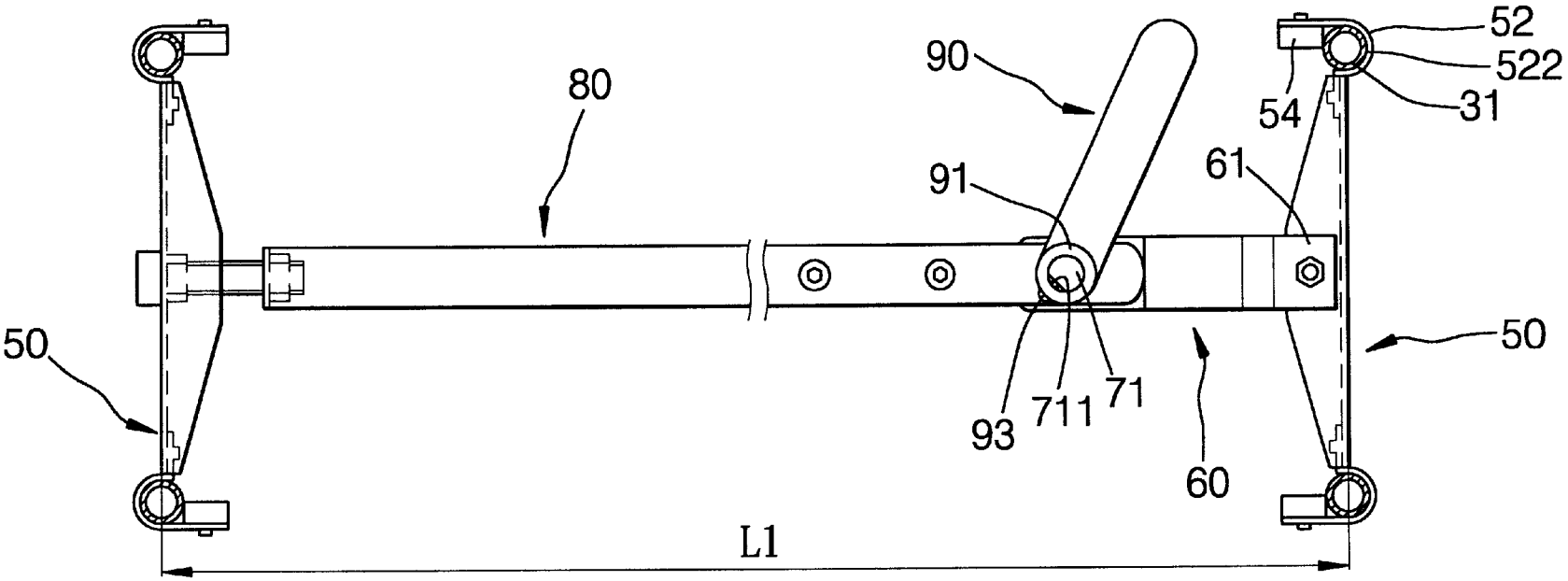
FIG. 10 is another schematic partly sectional top view of the preferred embodiment, illustrating how the cutter carriage is locked relative to the left and right pairs of upstanding posts.
Figure 11:
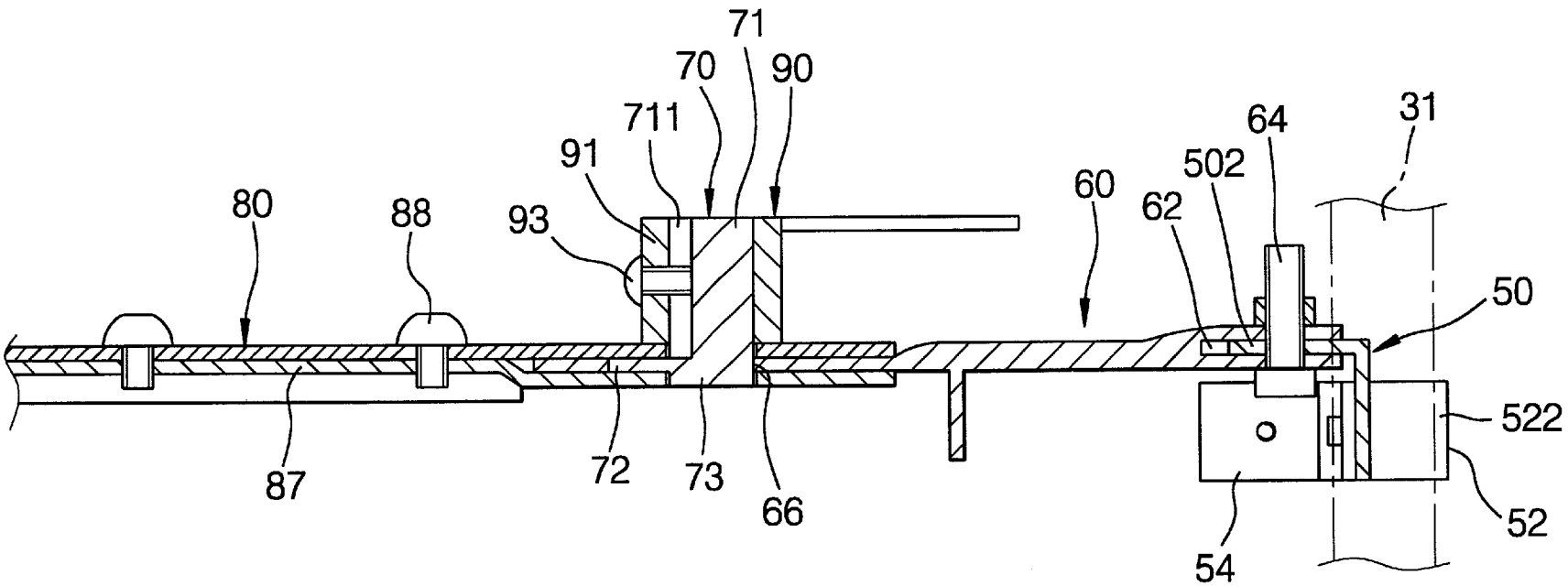
FIG. 11 is a schematic sectional side view of the preferred embodiment shown in FIG. 10, illustrating how the cutter carriage is locked relative to the left and right pair of the upstanding posts.

FIGS. 8 and 10 respectively show the carriage 40 (see FIG. 4) of the preferred embodiment in releasing and locking positions. When the carriage 40 is at the releasing position, a distance (L) defined between the left and right post bracing members 50 is greater than the distance (L1), and a clearance 100 (see FIG. 9) is formed between the embracing units 52 and the posts 31. When the carriage 40 is at the locking position, the embracing units 52 are in tight abutment with the posts 31 (see FIG. 11).

Each of the post embracing units 52 preferably has an inner flat portion 521 via which a screw 51 extends therethrough for mounting on the elongate plate portion 501 of the post bracing member 50, an outer flat portion 523 for mounting of an anchor block 54 via a screw 53, and an intermediate curve portion 522 between the inner and outer flat portions 521,523 for straddling around the post 31.

Note that the carriage locking mechanism employed in the preferred embodiment includes a relatively small number of components that can be formed using simple machining methods. As such, the cost of manufacturing is accordingly reduced. Moreover, since no springs are employed in the carriage locking mechanism, the possibility of weakening of the locking strength of the post bracing members 50 relative to the upstanding posts 31 due to spring fatigue as encountered in the prior art can be eliminated.

With the invention thus explained, it is apparent that numerous modifications and variations can be made without departing from the scope and spirit of this invention. It is intended that this invention be limited only as indicated in the appended claims.

I claim:

1. A wood planing machine comprising:

a machine base having opposite mounting sides spaced apart from each other in a transverse direction, and feed-in and take-out sides disposed apart from each other in a longitudinal direction;

left and right pairs of upstanding posts extending upward from said machine base at said mounting sides;

a cutter carriage disposed above said machine base, and having opposite end portions mounted movably on said upstanding posts for sliding movement of said cutter carriage along said upstanding posts;

moving means for moving said cutter carriage along said upstanding posts and for adjusting a height of said cutter carriage relative to said machine base; and a carriage locking mechanism for locking said cutter carriage at a desired height relative to said machine base, said carriage locking mechanism including left and right post bracing members disposed above said cutter carriage, each having an elongate plate portion that extends in the longitudinal direction at one side of a respective one of said left and right pairs of upstanding posts, and two substantially U-shaped post embracing units that are connected to opposite ends of said elongate plate portion for embracing said upstanding posts of said one of said left and right pairs, each of said left and right post bracing members being mounted on said cutter carriage, a right regulator plate disposed above said carriage to extend in said transverse direction, and having a first end portion pivotally connected to said elongate plate portion of said right post bracing member, and a second end portion with an annular wheel accommodating slot formed therein, a left regulator plate disposed above said carriage to extend in said transverse direction, and having a first end portion fixed to said elongate plate portion of said left post bracing member, and a second end portion overlapping said second end portion of said right regulator plate, said second end portion of said left regulator plate defining an annular shaft mounting hole therethrough in communication with said wheel accommodating slot and having an axis offset from an axis of said wheel accommodating slot, and a coupling shaft unit disposed rotatably through said shaft mounting hole in said left regulator plate, and having an eccentric wheel fixed eccentrically thereto and being confined rotatably within said wheel accommodating slot in said right regulator plate so as to interconnect said left and right regulator plates in said transverse direction, said eccentric wheel having an outer periphery in sliding contact with an inner periphery defining said wheel accommodating slot such that rotation of said coupling shaft unit in clockwise and counterclockwise directions results in synchronous rotation of said eccentric wheel within said wheel accommodating slot, thereby consequently causing movement of said left and right post bracing members toward each other or away from each other so as to cause said embracing units to clamp said posts or to release said posts.

2. The wood planing machine as defined in claim 1, further comprising an operating lever fixed to said coupling shaft unit to facilitate turning of said coupling shaft unit in said clockwise and counterclockwise directions.

3. The wood planing machine as defined in claim 1, wherein said left regulator plate includes a first left plate connected to said elongate plate portion of said left post bracing member, and a second left plate connected to said first left plate adjacent to said first end portion of said left regulator plate, said first and second left plates being disposed one over the other and sandwiching said second end portion of said right regulator plate, said shaft mounting hole having a first hole part in said first left plate and a second hole part in said second left plate, said first and second hole parts being aligned with said wheel accommodating slot.

4. The wood planing machine as defined in claim 3, wherein said coupling shaft unit further includes a first shaft part projecting from one side of said eccentric wheel into said first hole part, and a second shaft part projecting from the other side of said eccentric wheel into said second hole part, said first and second shaft parts being coaxial with one another and being off-center relative to said eccentric wheel.

* * * * *